US009044643B2

(12) United States Patent
Staten et al.

(10) Patent No.: US 9,044,643 B2
(45) Date of Patent: Jun. 2, 2015

(54) WEIGHTLIFTING EQUIPMENT SUPPORT ASSEMBLY

(75) Inventors: Kenneth E. Staten, Clare, MI (US); Kyle R. Camp, Clare, MI (US)

(73) Assignee: Rogers Athletic Company, Inc., Clare, MI (US)

( * ) Notice: Subject to any disclaimer, the term of this patent is extended or adjusted under 35 U.S.C. 154(b) by 265 days.

(21) Appl. No.: 13/469,502

(22) Filed: May 11, 2012

(65) Prior Publication Data

US 2012/0289384 A1 Nov. 15, 2012

Related U.S. Application Data

(60) Provisional application No. 61/485,367, filed on May 12, 2011.

(51) Int. Cl.
*A63B 21/00* (2006.01)
*A63B 21/078* (2006.01)

(52) U.S. Cl.
CPC ..... *A63B 21/078* (2013.01); *A63B 2021/0783* (2013.01)

(58) Field of Classification Search
USPC ..... 482/106, 104, 109, 101, 45, 111, 112; D21/694
See application file for complete search history.

(56) References Cited

U.S. PATENT DOCUMENTS

| | | | | | |
|---|---|---|---|---|---|
| 4,527,797 | A * | 7/1985 | Slade et al. | ..... | 482/101 |
| 5,141,480 | A * | 8/1992 | Lennox et al. | ..... | 482/104 |
| 5,215,510 | A * | 6/1993 | Baran | ..... | 482/104 |
| D444,827 | S * | 7/2001 | Mobley | ..... | D21/694 |
| D562,670 | S * | 2/2008 | Rogers et al. | ..... | D8/330 |
| 7,374,516 | B2 * | 5/2008 | Lundquist | ..... | 482/104 |

* cited by examiner

*Primary Examiner* — Jerome w Donnelly
(74) *Attorney, Agent, or Firm* — Carlson, Gaskey & Olds, P.C.

(57) ABSTRACT

This disclosure provides a weight support assembly including a main support mountable to an upright frame member to define a coarse position and a secondary support movable relative to the main support to define a fine position.

21 Claims, 19 Drawing Sheets

WEIGHTLIFTING EQUIPMENT SUPPORT ASSEMBLY

REFERENCE TO RELATED APPLICATION

This application claims priority to U.S. Provisional Application No. 61/485,367 filed May 12, 2011.

BACKGROUND

This disclosure relates to weightlifting equipment and, more particularly, to an assembly for supporting weightlifting equipment.

Individuals may perform various exercises to, for example, develop and train the individual's body. Exercises can be performed using free weights, such as barbells, or with machines. Many individuals prefer free weights, which allow the individual to perform exercises in a natural motion while utilizing body leverage in performing the exercise. This facilitates isolation of particular muscle groups of the individual's body.

Between "sets," free weights are typically rested on a support assembly mounted directly to a frame rack. The support assembly may be adjustable relative to the frame rack to locate a rested weight bar at a desired height. Conventional support assemblies include posts or hooks that engage the frame rack at one of several possible vertical locations.

SUMMARY

This disclosure provides a weight support assembly including a main support mountable to an upright frame member to define a coarse position and a secondary support movable relative to the main support to define a fine position.

Additionally, this disclosure provides a method of operating the weight support assembly including attaching the main support relative to the frame member to define a course adjustment and adjusting a secondary support relative to the main support to define a fine adjustment.

BRIEF DESCRIPTION OF THE DRAWINGS

The various features and advantages of this disclosure will become apparent to those skilled in the art from the following detailed description of example embodiments. The drawings that accompany the detailed description can be briefly described as follows.

DETAILED DESCRIPTION

Figure 1:
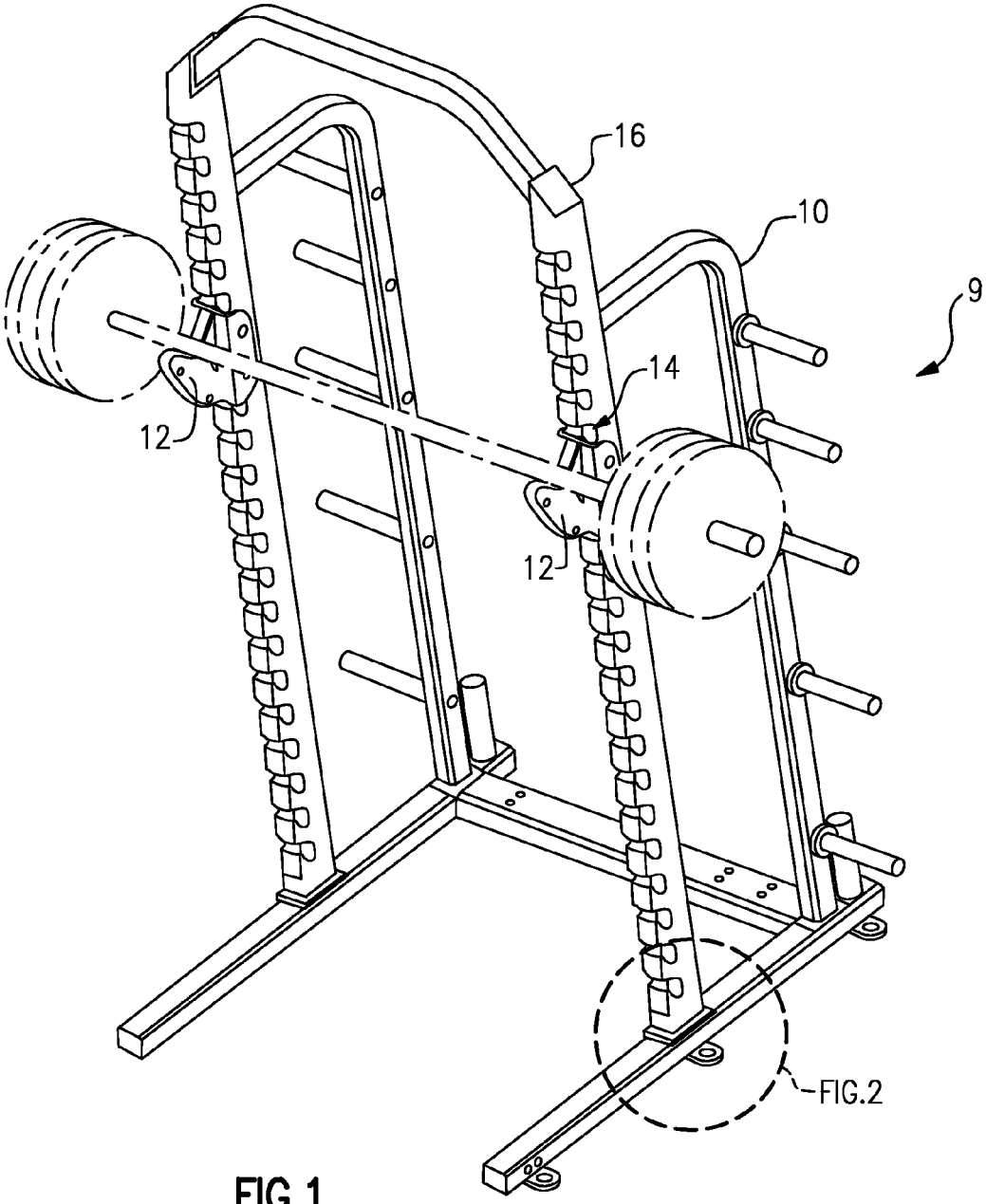
FIG. 1 is a general perspective view of an example weightlifting system.

FIG. 1 illustrates an exploded view of an example weightlifting system 9 including a frame rack 10 and an example weight support assembly 12 (two shown). The frame rack 10 is a type of support for the support assembly 12. It should be understood that although a particular frame rack is illustrated in the example embodiment, other types of supports and frame racks 10 could be used to support the support assembly 12.

The frame rack 10 includes a multitude of openings 14 along an upright frame member 16. Pairs 15 of the openings 14 are configured to receive the support assembly 12. The support assembly 12 is received in selected pairs 15 of openings 14 so that the support assembly 12 may be located near a desired vertical position. In this example, each of the pairs 15 of openings 14 is separated from the next by approximately four inches to provide significant incremental adjustment, however, any separation (including varied separations) is possible.

Figure 2:
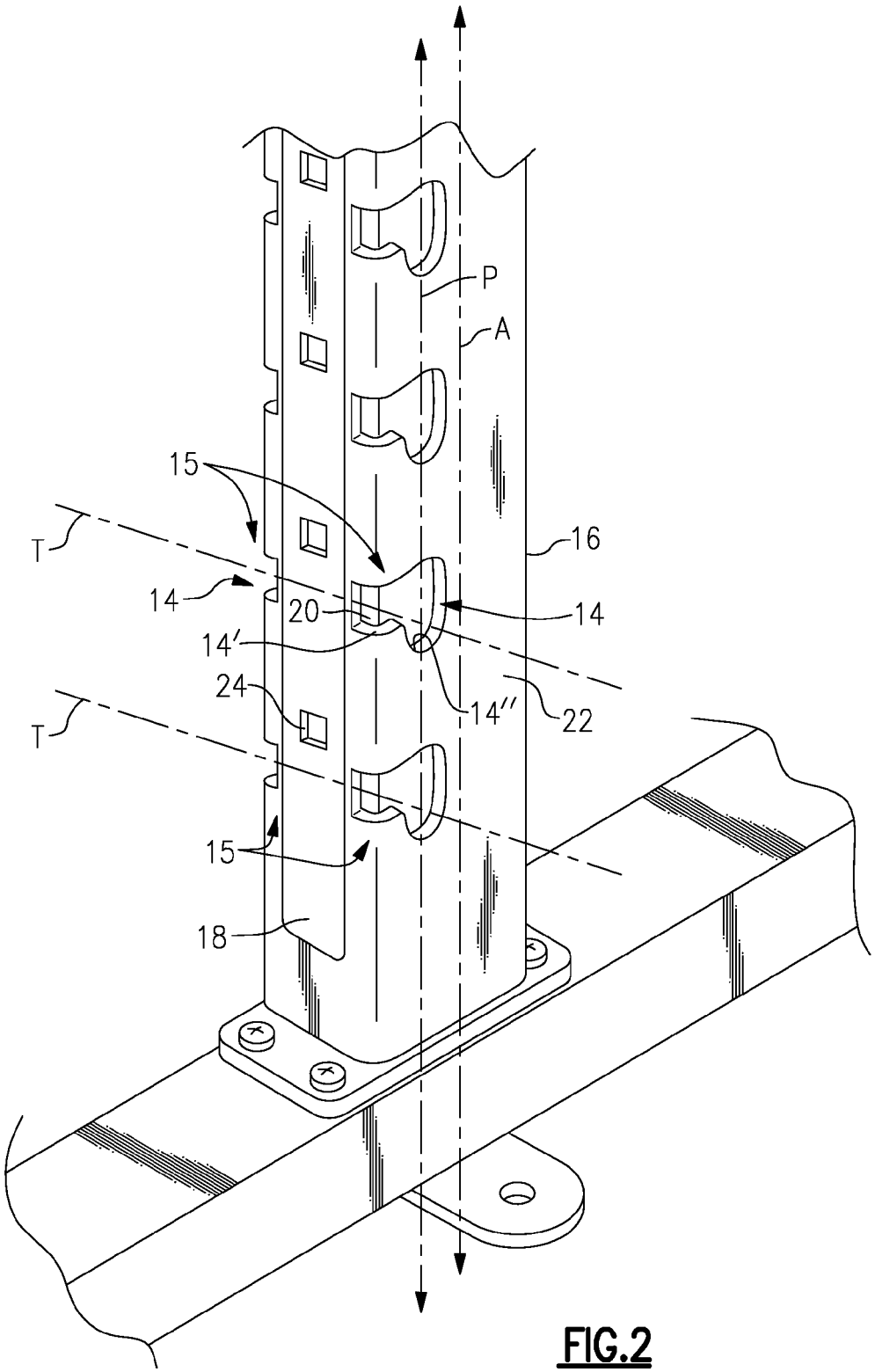
FIG. 2 is an expanded view of an upright frame member of the system of FIG. 1.

Referring to FIG. 2, each upright frame member 16 defines a longitudinal axis A extending vertically relative to the ground. Other types of frame members extend in other directions. The example upright frame member 16 is generally rectilinear in shape and is manufactured of tubing that is rectangular in cross-section. The upright frame member 16 has a front face 18, a first side face 20, and a second side face 22. The upright frame member 16 includes a plurality of opposed pairs of openings 14*a*, 14*b* along the longitudinal axis A. Each of the opposed pairs of openings 14*a*, 14*b* includes a first opening portion 14' and a second opening 14".

Each opening 14 is generally L-shaped and spans the intersection of the front face 18 and one of the side faces 20, 22. In this non-limiting embodiment, the first opening portion 14' spans the front face 18 and the side face 20 and the second opening portion 14" spans the front face 18 and the side face 22. In other words, each opening 14 cuts through the corner of the upright frame member 16.

Figure 3:
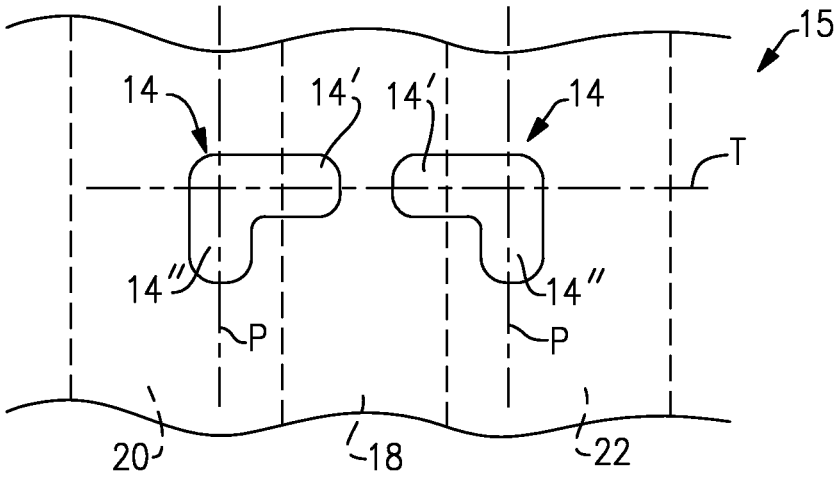
FIG. 3 is a schematic view of an opening in the upright frame member of FIG. 2.

The example first opening portions 14' in the front face 18 are generally transverse to the longitudinal axis A along a transverse opening axis T. The example second opening portions 14" within a pair 15 are generally parallel to the longitudinal axis A along a parallel opening axis P. The second opening portions 14" extend through the first side face 20 and the second opening portions 14" extend through the second side face 22. The second opening portions 14" within a pair 15 are generally parallel to the longitudinal axis A along the parallel axis P. The first opening portions 14' and the second opening portions 14" are generally perpendicular and the first opening portions 14' of a pair 15 are generally parallel if laid flat (FIG. 3). In this example, each opening 14 includes relatively large corner radiuses.

A lock opening 24 is located through the front face 18 between each vertically separated pair 15 of openings 14*a*, 14*b* (FIG. 2). In this example, each lock opening 24 is parallel to the longitudinal axis A and is generally square in shape. It should be understood that other shapes will also be readily usable with the present invention. The example lock opening 24 is longitudinally staggered above each pair 15 of openings 14*a*, 14*b*.

Figure 4:
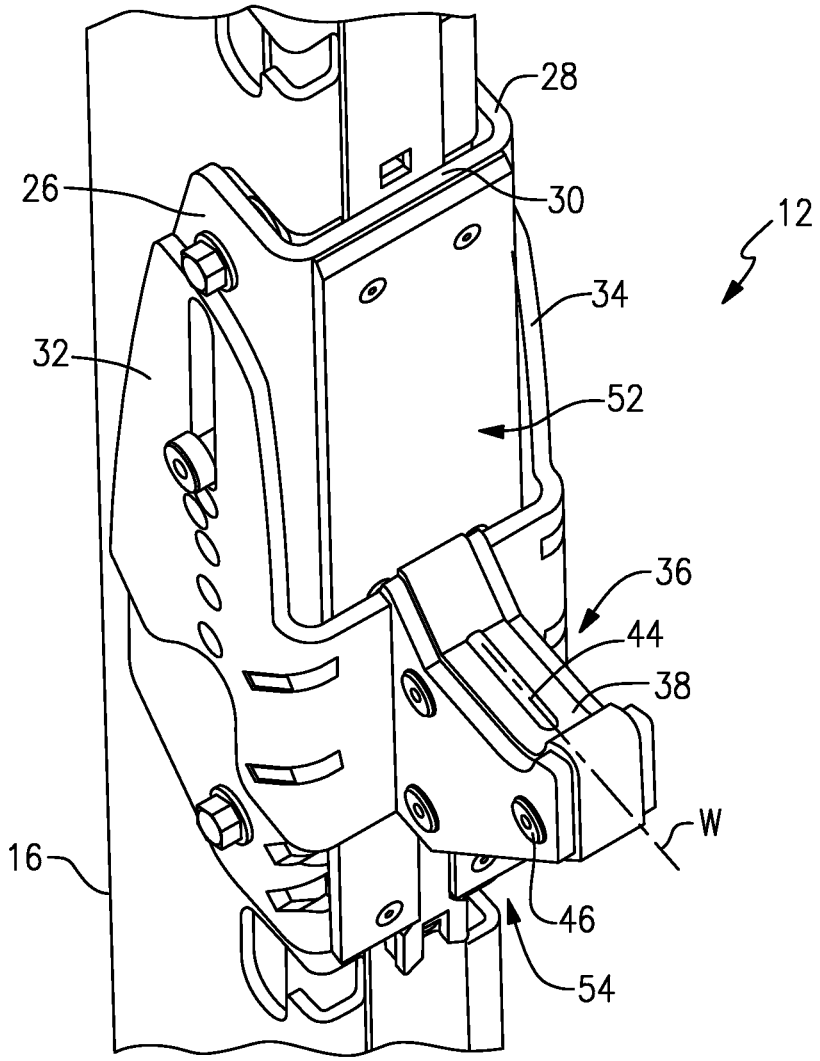
FIG. 4 is a front perspective view of an example support assembly mounted to the upright frame member.

Referring to FIG. 4, the support assembly 12 includes a main support 52 having a first support plate 26 opposed to and generally parallel with a second support plate 28. The support plates 26, 28 extend generally perpendicularly from a central support plate 30 to form a generally U-shape. The main support 52 may be manufactured from a single, integral U-channel member.

An adjustable secondary support 54 of the support assembly 12 includes a first hook plate 32 and a second hook plate 34 that at least partially surround the main support 52. Although example hook plates 32, 34 are illustrated, hook plates of various shapes will also be usable with the example embodiment so long as the hook plates provide an effective and secure receipt area for a weight bar or other weightlifting component.

The hook plates 32, 34 include a recessed portion 36 that can receive a weight bar (FIG. 1) or another type of weightlifting equipment. In this example, a non-metallic bumper 38 extends between the first hook plate 32 and the second hook plate 34 to cushion impacts with a weight bar and provide a smooth gripping surface. In other examples, a peg is used in place of the recessed portion 36.

A wear pin 44, such as a roller bearing, is mounted to the non-metallic bumper 38 adjacent the base of the recessed portion 36. The wear pin 44 rotates about a rotational axis W that is generally perpendicular to an outward facing surface of the central support plate 30. The wear pin 44 rotates about the axis W to facilitate positioning of the weight bar in a direction generally perpendicular to the axis W. Therefore, the wear pin 44 provides a rotational surface rather than a flat surface such that the weight bar is more readily positioned than with a conventional flat surface.

Figure 5:
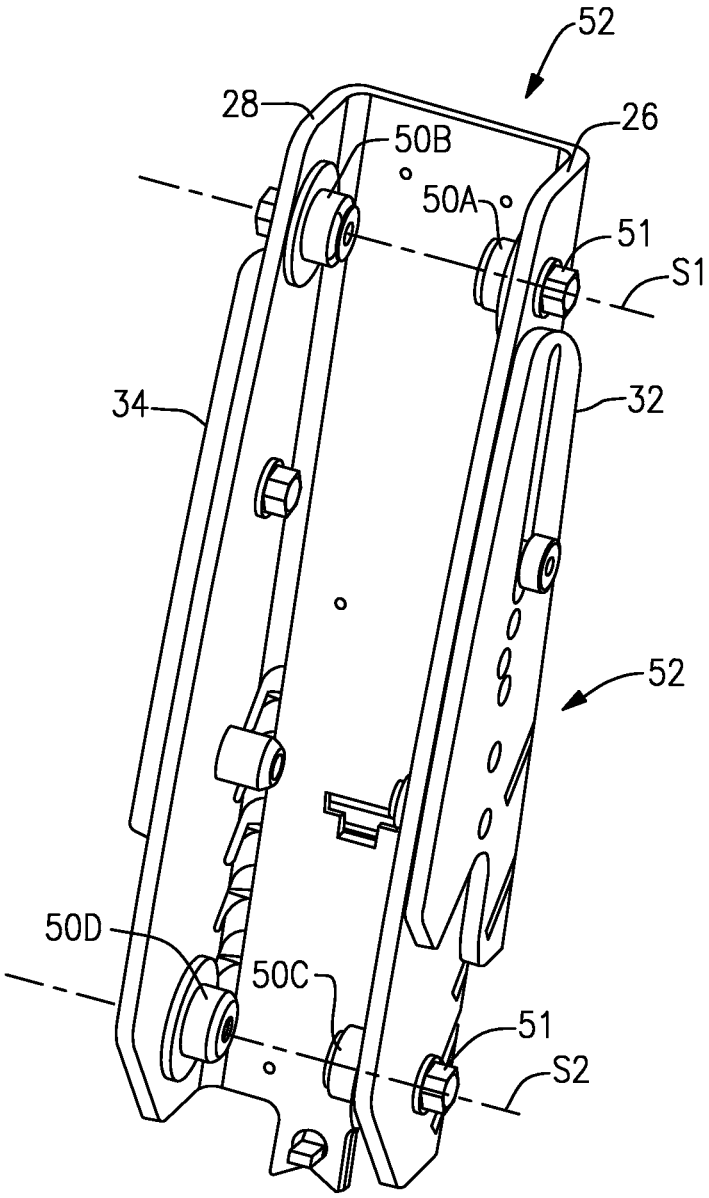
FIG. 5 is a rear perspective view of the support assembly of FIG. 4.
Figure 6:
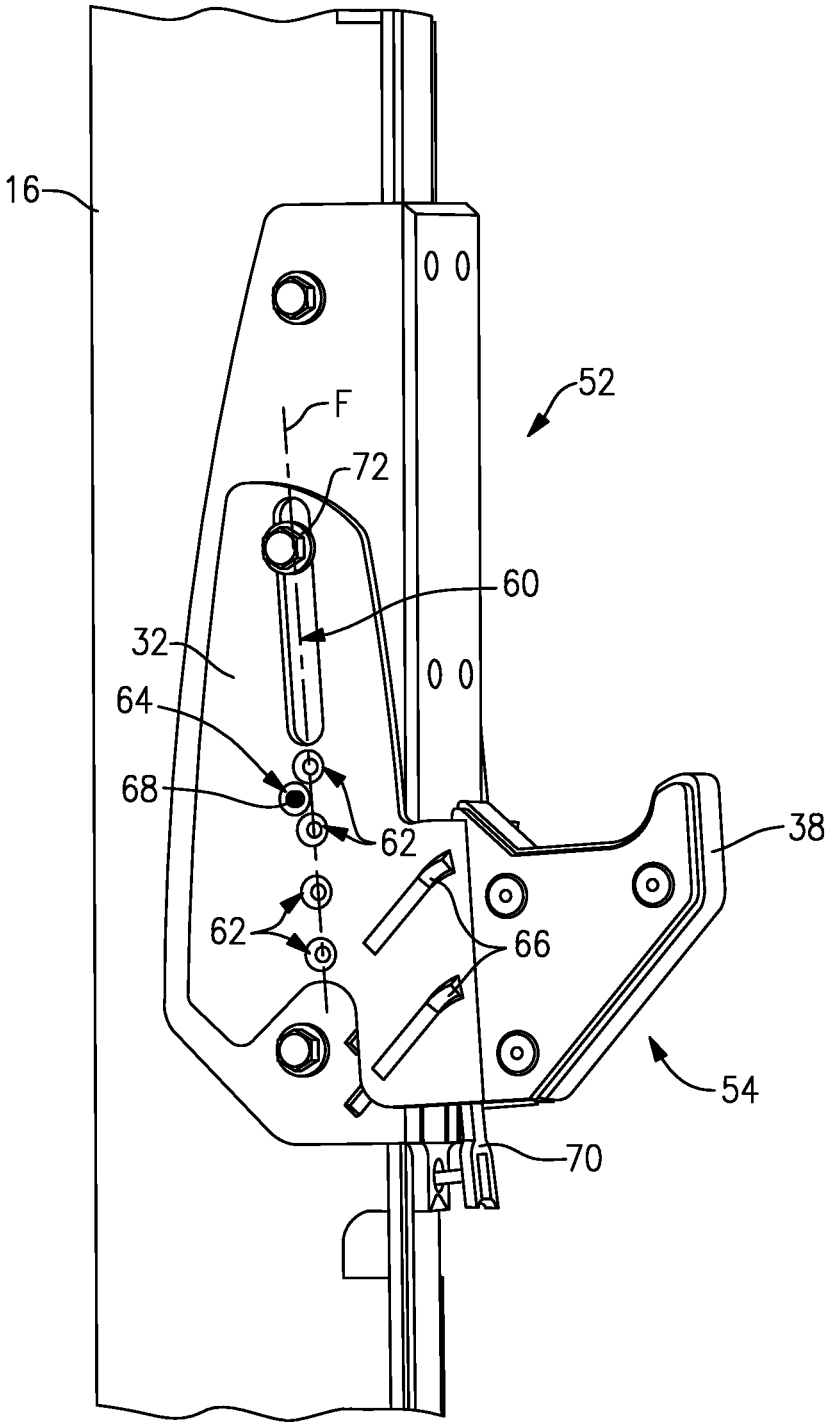
FIG. 6 is a side view of the support assembly of FIG. 4 with a secondary support in a locked position relative to a main support.

Referring to FIG. 5, a first, second, third and fourth stud 50*a*-50*d* extend from an inner surface of the support plates 26, 28. The studs 50A-50*d* are configured to engage the openings 14 (FIG. 2). The first stud 50*a* extends from the first support plate 26 and is directly opposed to the second stud 50*b*, which extends from an inner surface of the second support plate 28. The third stud 50*c* extends from the first support plate 26 and is directly opposed to the fourth stud 50*d*, which extends from an inner surface of the second support plate 28. The first and second studs 50*a*, 50*b* are located on a common axis S1 and the third and fourth studs 50*c*, 50*d* are located along a common axis S2. The studs 50*a*-50*d* are relatively significant solid members that mount through the support plates 26, 28 with fasteners 51 or the like.

The first and second studs 50*a*, 50*b* are received within one pair 15 of openings 14 and the third and fourth studs 50*c*, 50*d* are received within another pair 15 of openings 14. The studs 50*a*-50*d* are received within the pairs 15 of openings 14 to position the support assembly 12 near the desired vertical position. The studs 50*a*-50*d* provide a course adjustment of the support assembly 12 in increments equal to the distance between adjacent pairs 15 of openings 14.

The example secondary support 54 provides a fine adjustment for the support assembly 12 through relative movement with respect to the main support 52. The main support 52 is mountable to the openings 14 on the upright frame member 16, which may be generally separated by, for example, four inches, while the secondary support 54 provides further fine adjustments between the openings 14 in, for example, one inch increments. The support assembly 12 may be mounted to the desired openings 14 then the secondary support 54 is adjusted relative to the main support 52 to provide fine adjustment. Such fine adjustability is readily advantageous for a user who requires fine position prior to performing an exercise with what may be an exceedingly heavy weight.

With reference to FIG. 6-11, the secondary support 54 generally includes a slot 60, a multiple of fine position apertures 62, a dock aperture 64, and a multiple of angled interfaces 66. A spring loaded push button 68, such as a Velco button, selectively engages apertures 62, 64 to position the secondary support 54 relative to the main support 52.

The dock aperture 64 is spaced from an axis F upon which the slot 60 and apertures 62 are arranged. Positioning the button 68 in the dock aperture 64 locks the secondary support 54 relative to the main support 52 and disengages a latch 70 from lock openings 24 (FIG. 2) by increasing the distance between the main support 52 and the secondary support 54. The dock aperture 64 may facilitate positioning of the support assembly 12 with one hand into the desired openings 14 of the upright frame members 16 by locking the main support 52 relative to the secondary support 54 with the latch 70 in the disengaged position. The locked and disengaged position also allows the support assembly 12 to be removed from the upright frame members 16 with one hand. When the secondary support 54 is located in the locked and disengaged position with the button 68 in the dock aperture 64, the secondary support 54 may be used as a handle to allow the user to easily more the support assembly 12. The dock aperture 64 and the apertures 62 may include tapered sidewalls to increase a user's ability to depress the button 68 so that it disengages the secondary support 54.

Figure 7:
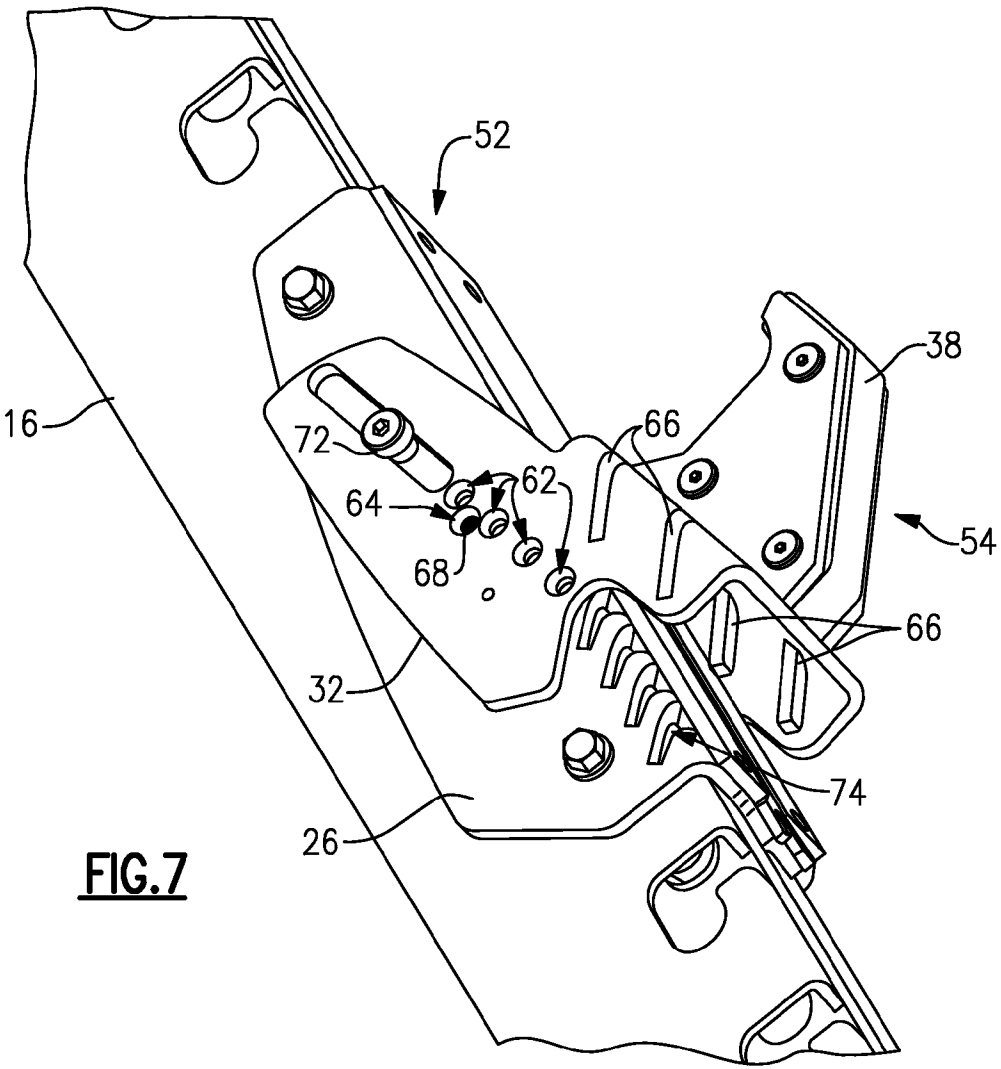
FIG. 7 is a side perspective view of the support assembly of FIG. 4 with the secondary support in an intermediate position relative to the main support to provide fine positioning.
Figure 8:
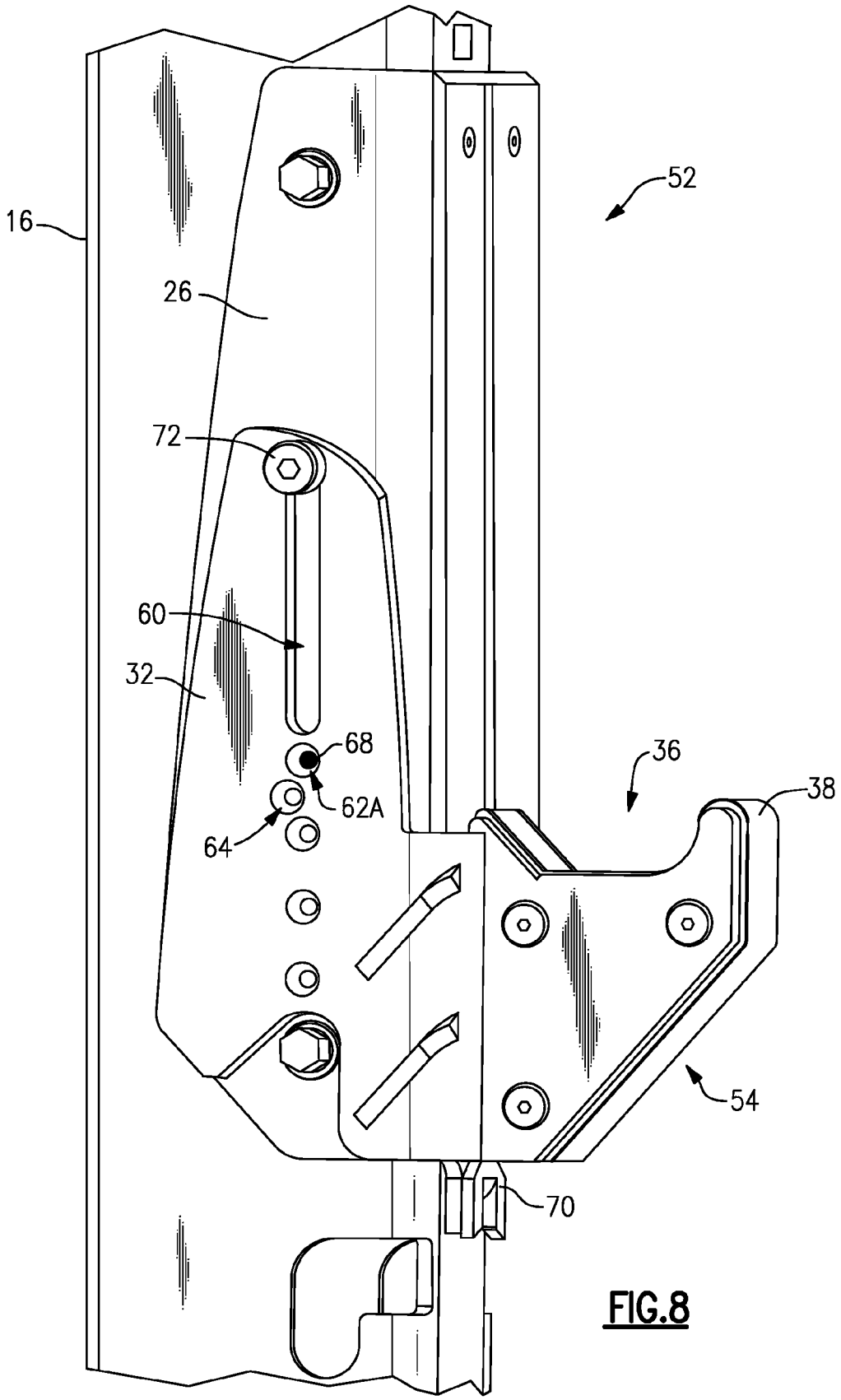
FIG. 8 is a side view of the support assembly of FIG. 4 with the secondary support in a first position relative to the main support.
Figure 9:
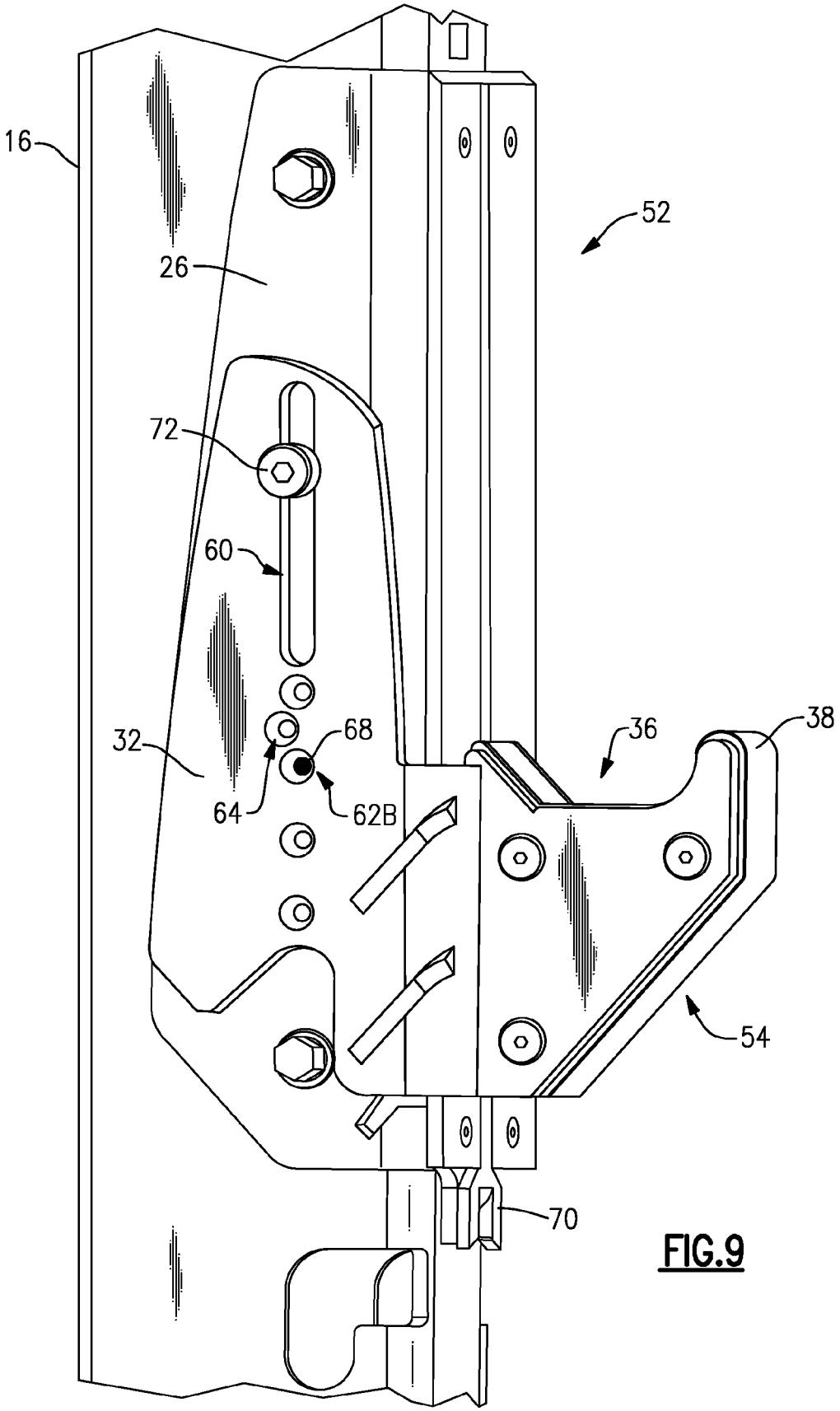
FIG. 9 is a side view of the support assembly of FIG. 4 with the secondary support in a second position relative to the main support.
Figure 10:
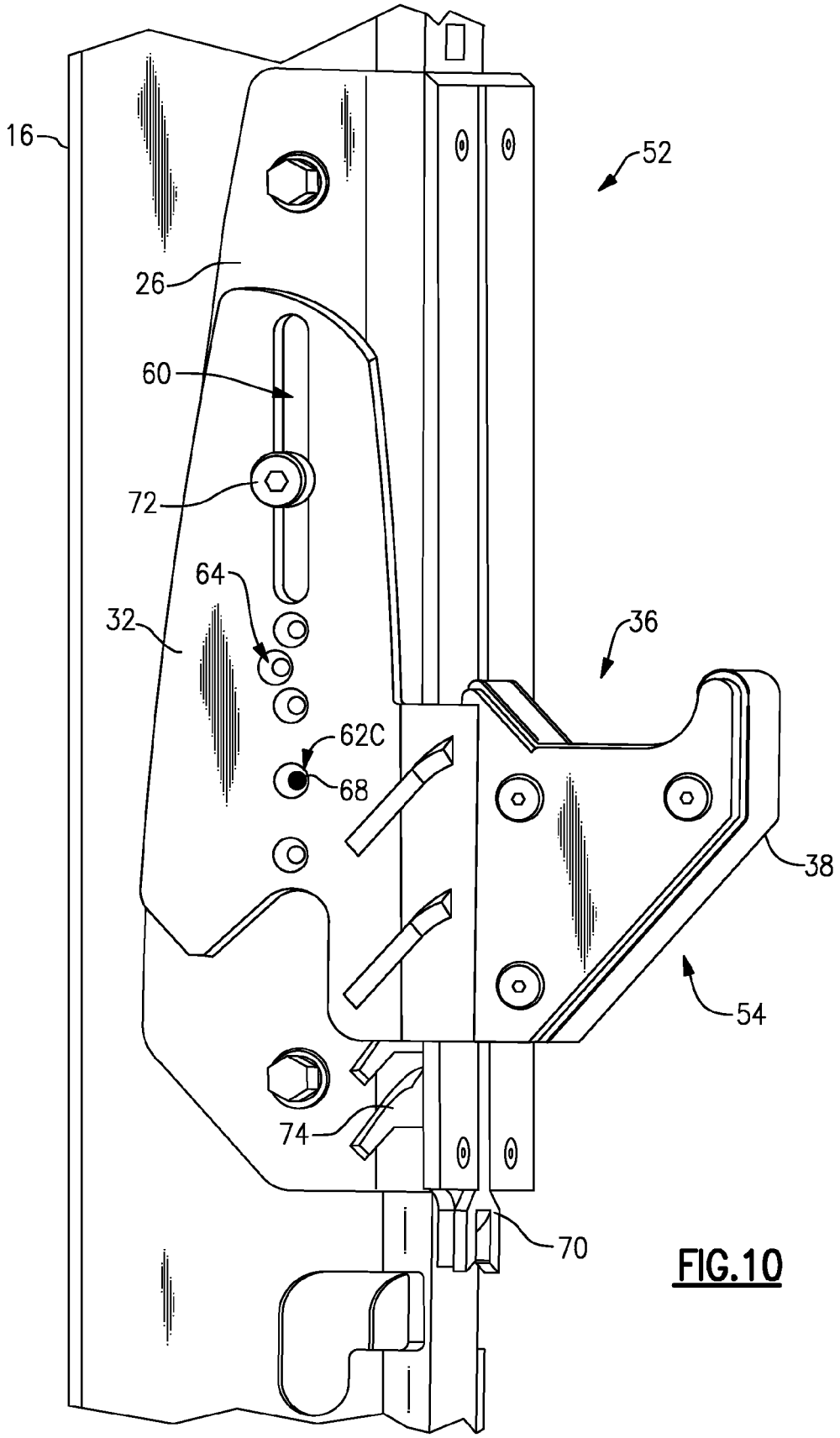
FIG. 10 is a side view of the support assembly of FIG. 4 with the secondary support in a third position relative to the main support.
Figure 11:
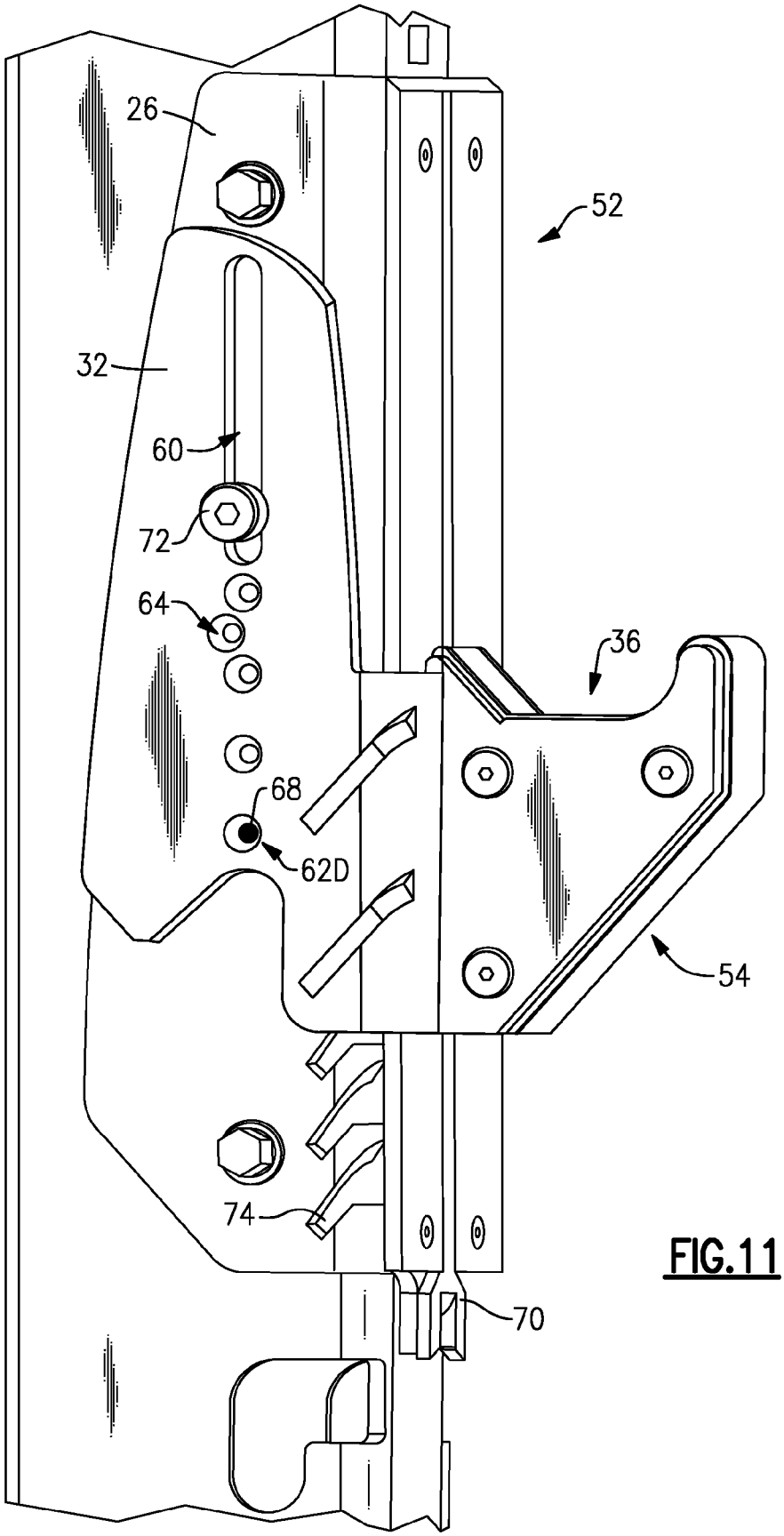
FIG. 11 is a side view of the support assembly of FIG. 4 with the secondary support in a fourth position relative to the main support.

Once the main support 52 is positioned in the desired openings 14 of the upright frame member 16, the button 68 is depressed so that the secondary support 54 is movable to a position with the button 68 aligned with one of the apertures 62 and angled interfaces 66 align with corresponding slots 74. Each aperture 62 corresponds with a position of the secondary support 54 such that the secondary support 54 is selectively positioned with respect to the main support 52. The angled interface 66 are arranged transverse to axis F so that the secondary support 54 may be pivoted about stud 72 within slot 60 to provide the respective fine engagement such that angled interfaces 66 are engaged with slots 74 in the main support 52 (FIG. 7). Insertion of angled interfaces 66 into the desired slots 74 thereby provides the fine positioning of the secondary support 54 with respect to the main support 52 and rigidly secures the main support 52 to the secondary support 54. Notably, the interface between angled interfaces 66 with slots 74 provide a significant, robust interface which supports a significant weight bar load when placed on the support assembly 12 (FIG. 1).

As the angled interfaces 66 are positioned into the selected slots 74, the button 68 will then engage the respective aperture 62 to lock the secondary support 54 with the main support 52 at one of, for example, four positions as illustrated in FIGS. 8-11. It should be understood that any number of such fine positions may be provided and the relationship between the secondary support 54 and the main support 52 should not be construed as limited to only four positions or the aforementioned inch wide increments.

As the secondary support 54 is positioned with respect to the main support 52, pivoting the secondary support 54 to engage the angled interfaces 66 with the slots 74 also drives the latch 70 into the respective lock opening 24 (FIG. 2).

The interaction between the latch 70 and the lock opening 24 thereby holds the support assembly 12 at the desired coarse and fine locked positions. When locked, the support assembly 12 cannot be jarred should the weight bar inadvertently strike the support assembly 12 from a below directed position.

Figure 12:
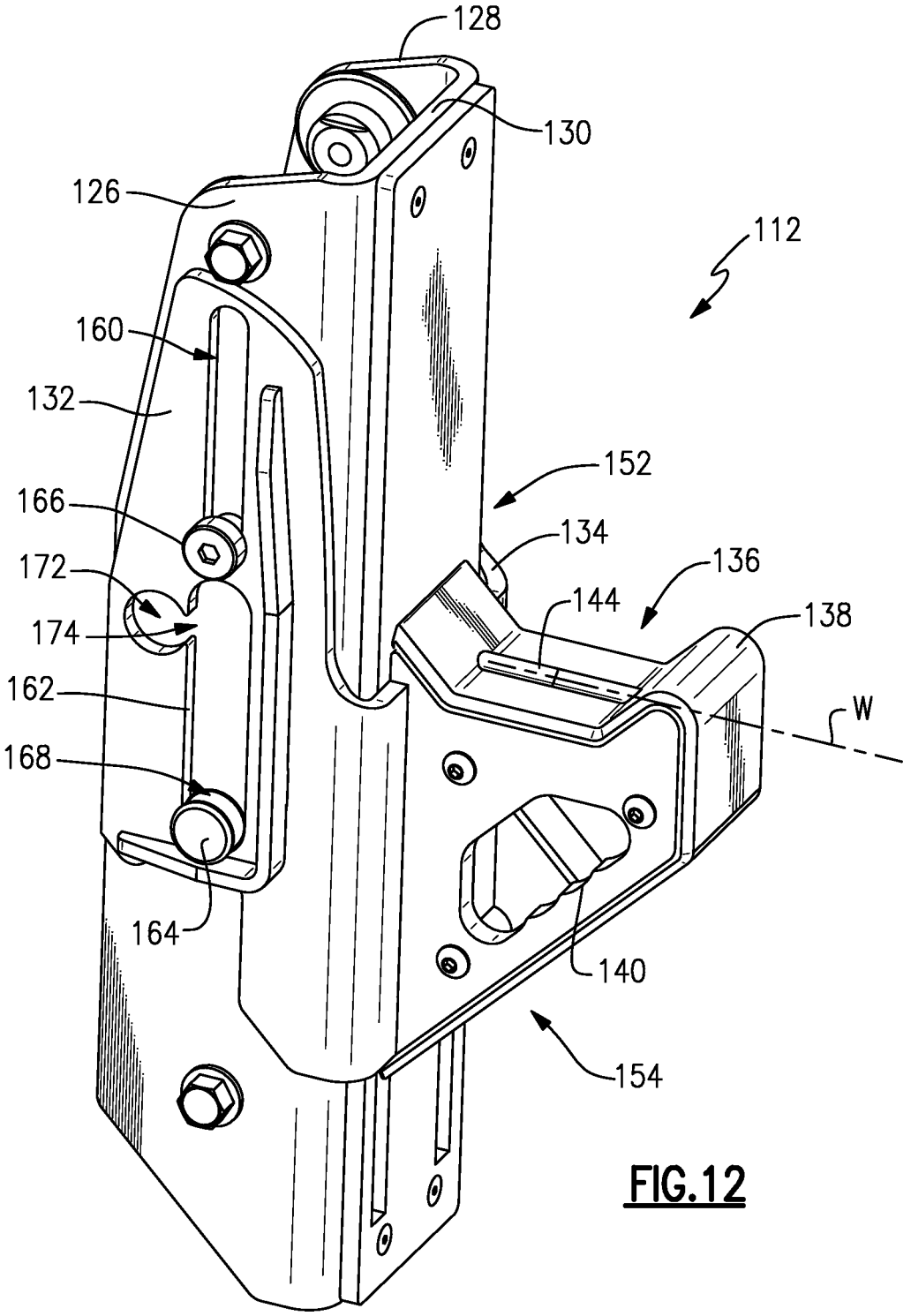
FIG. 12 is general perspective view of a support assembly according to another example embodiment.
Figure 13:
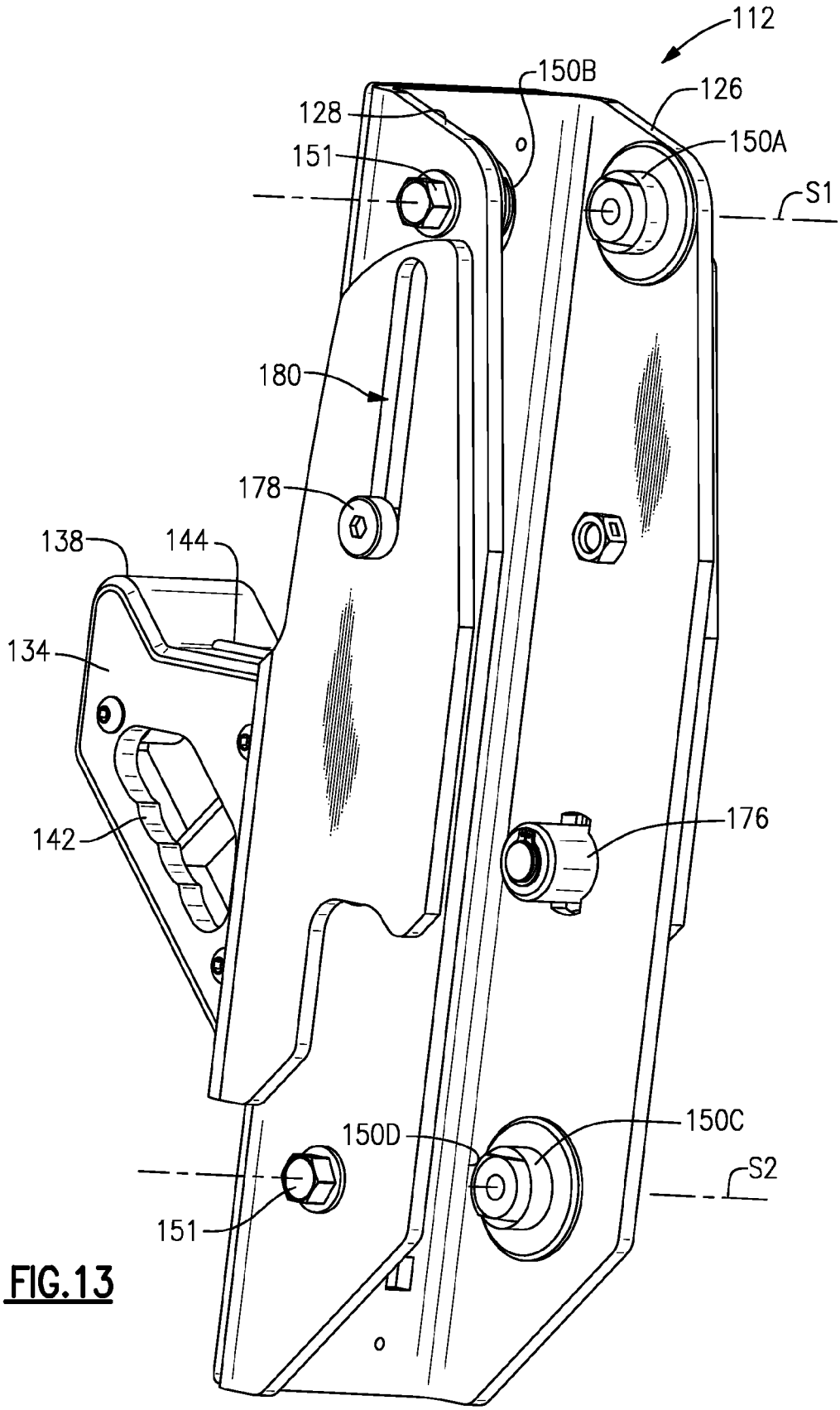
FIG. 13 is a general rear perspective view of the support assembly of FIG. 12.
Figure 14:
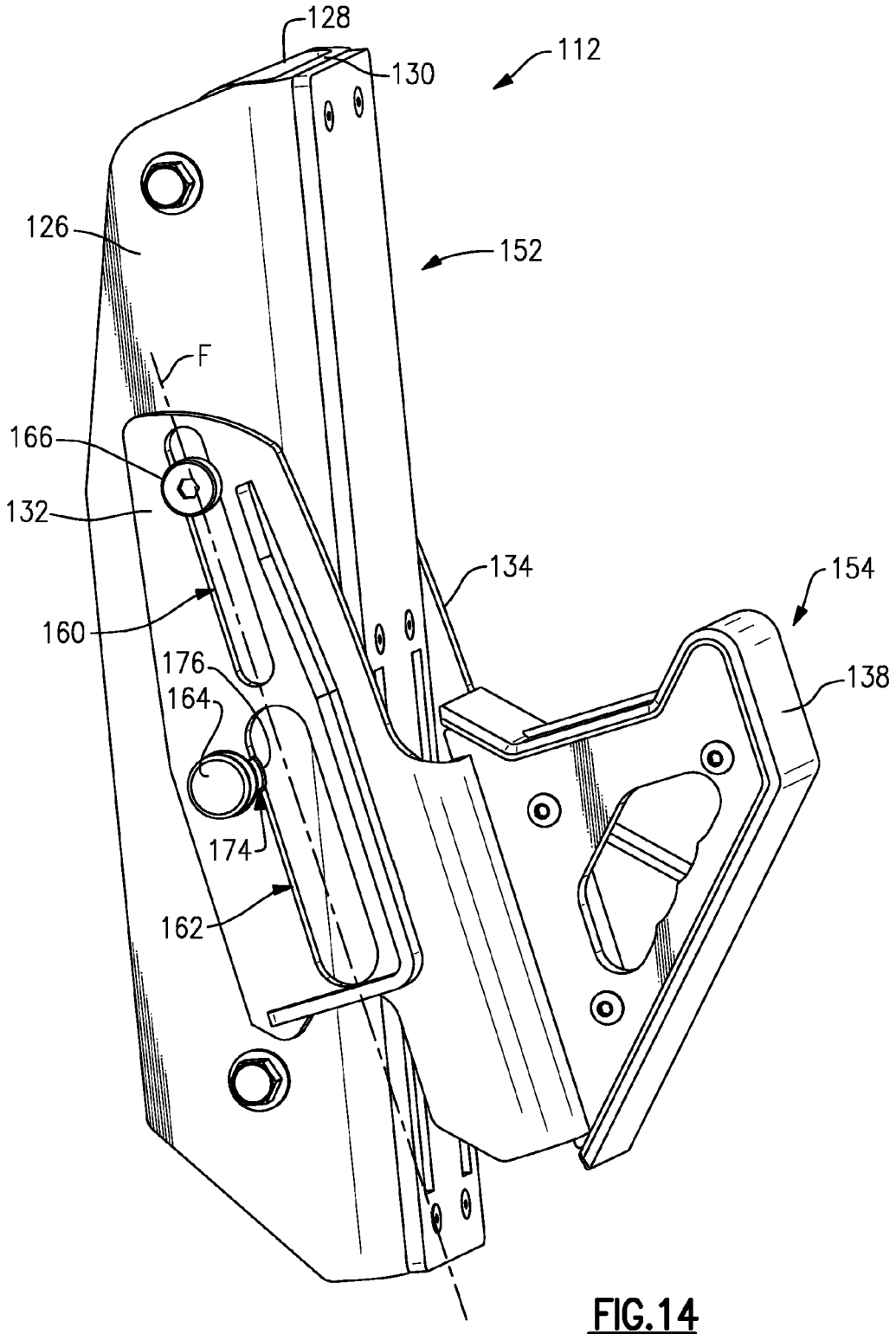
FIG. 14 is a general perspective view of the support assembly of FIG. 12.
Figure 15:
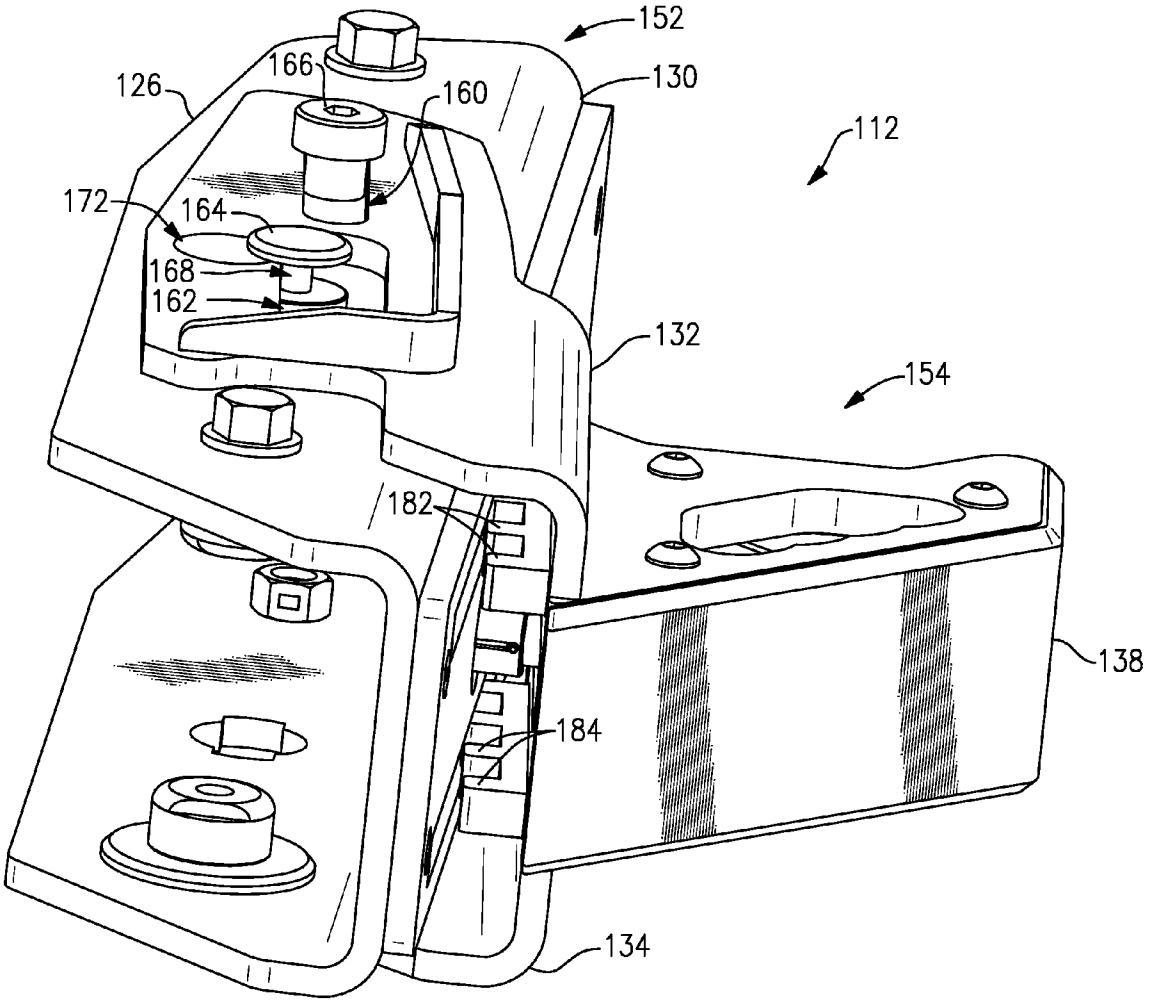
FIG. 15 is a general perspective bottom view of the support assembly of FIG. 12.
Figure 16:
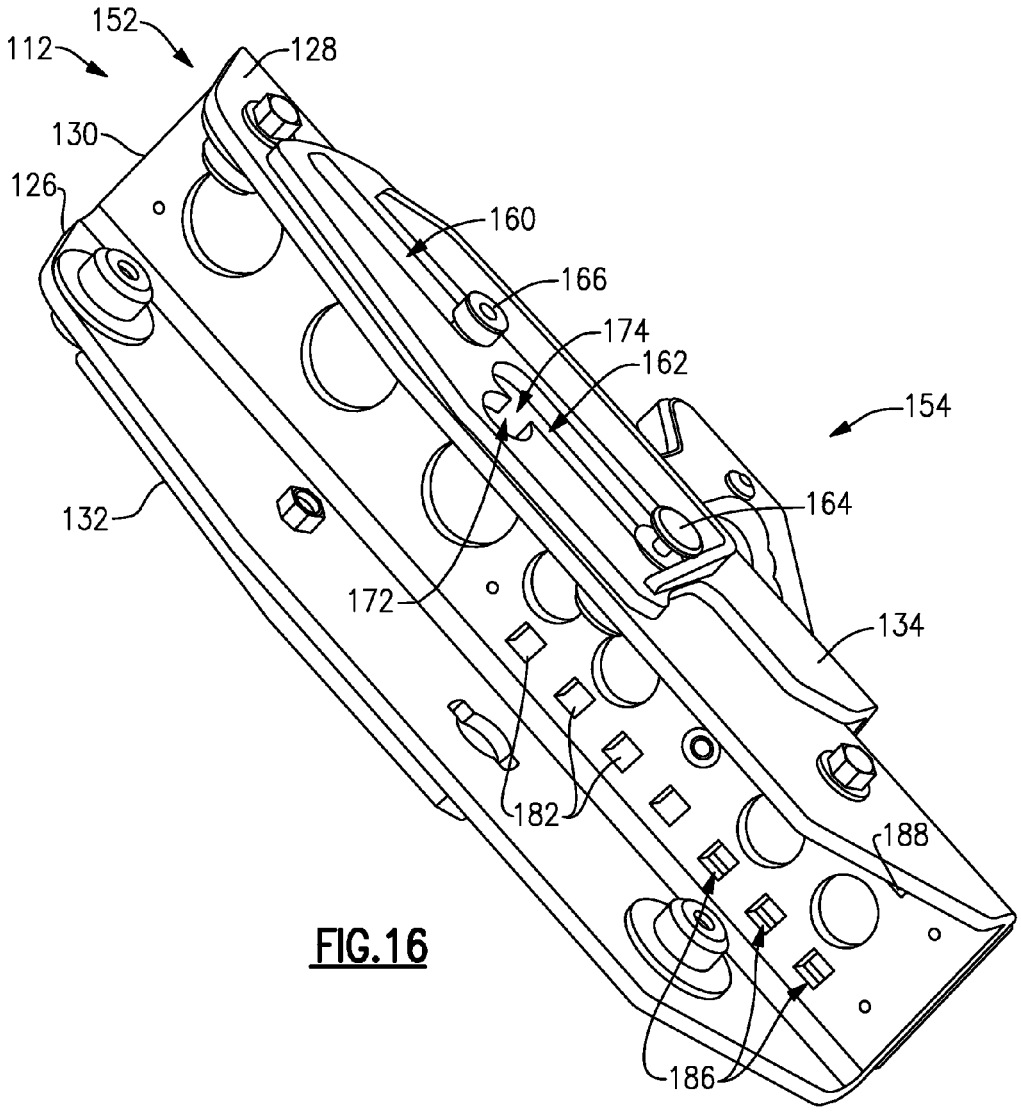
FIG. 16 is a general rear perspective view of the support assembly of FIG. 12.

FIG. 12 illustrates a weight support assembly 112 according to another example embodiment. The weight support assembly 112 includes a main support 152 and an adjustable secondary support 154 moveable relative to the main support 152. The main support 152 includes a first support plate 126 opposed to and generally parallel with a second support plate 128. The support plates 126, 128 extend generally perpendicularly from a central support plate 130 to form a U-shape. The main support 152 may be manufactured from a single, integral U-channel member (also illustrated in FIG. 13).

The example secondary support 154 of the support assembly 112 includes a first hook plate 132 and a second hook plate 134 that at least partially surround the main support 152. Although example first and second hook plates 132, 134 are illustrated, other hook plates having other shapes could also be used.

The hook plates 132, 134 include a recessed portion 136 that can receive the weight bar or another type of weight lighting equipment. In this example, a non-metallic bumper 138 extends between the first hook plate 132 and the second hook plate 134 to cushion impacts with the weight bar and to provide a smooth gripping surface. The first hook plate 132 includes a first handle portion 140 formed by an opening extending through the first hook plate 132 and the second hook plate 134 includes a second handle portion 142 formed by an opening extending through the second hook plate 134. The first and second handles 140, 142 each include a contoured portion to facilitate gripping by a user.

A wear pin 144, such as a roller bearing, is mounted to the non-metallic bumper 138 adjacent the base of the recessed portion 136 for rotation about a rotational axis W that is generally perpendicular to an outer surface of the central support plate 130. The wear pin 144 rotates about the axis W to facilitate positioning of the weight bar in a direction generally perpendicular to the axis W. Therefore, the wear pin 144 provides a rotational surface rather than a flat surface such that the weight bar is more readily positioned than with a conventional flat surface.

Referring to FIGS. 13 to 16 with continuing reference to FIG. 12, a first, second, third, and fourth stud 150*a*-150*d* extend from an inner surface of the support plates 126, 128. The studs 150*aa*-150*c* are configured to engage the openings 14 on the upright frame members 16 (FIG. 2). The first stud 150*a* extends from the first support plate 126 and is directly opposed to the second stud 150*b* which extends from an inner surface of the second support plate 128. The third stud 150*c* extends from the first support plate 126 and is directly opposed to the fourth stud 150*d* which extends from an inner surface of the second support plate 128. The first and second studs 150*a*, 150*b* are located on a common axis S1 and the third and fourth studs 150*c*, 150*d* are located along a common axis S2. The studs 150*a*-150*d* are relatively significant solid members that mount through the support plates 126, 128 with fasteners 151 or the like.

Course adjustments of the support assembly 112 are accomplished by aligning the studs 150*a*-150*d* with the openings 14 on the upright frame member 16. Adjustment between adjacent openings 14 on the upright frame member 16 allows for movement of the support assembly in course increments, such as four inch increments in this example, in the vertical direction. Once the main support 152 is attached to the upright frame member 16, the secondary support 154 may be moved relative to the main support 152 in fine increments, such as one inch increments in this example, in the vertical direction.

A stud 178 is fixedly attached to the second support plate 128 and is accepted within a slot 180 on the second hook plate 134. The slot 180 extends in a direction generally parallel to a first slot 160 on the first hook plate 132 to allow the secondary support 154 to move relative to the main support 152.

The first hook plate 132 on the secondary support 154 includes the first slot 160, a second slot 162, a dock aperture 172, and a connecting portion 174 that connects the dock aperture 172 with the second slot 162. The first slot 160 and the second slot 162 generally extend along the same axis F. A stud 166 is rigidly attached to the first support plate 126 on the main support 152 and is configured to travel in a longitudinal direction through the first slot 160.

A button 164 is slidably attached to the first support plate 126 in a direction generally perpendicular to the first support plate 126. The button 164 includes a groove 168 having a width greater than or equal to the thickness of the first hook plate 132 so that the first hook plate 132 can travel through the groove 168. The button 164 includes a shaft 176 that extends into an internal space defined by the first support plate 126, the second support plate 128, and the central support plate 130 for engaging one of the openings 14 on the upright frame member 16 to lock the main support 152 relative to the upright frame member 16.

A first plurality of teeth 182 is attached to the first hook plate 132 and a second plurality of teeth 184 is attached to the second hook plate 134. Each of the first and second plurality of teeth 182, 184 are generally linearly arranged and offset from each other. The first plurality of teeth 182 align with and engage a first plurality of openings 186 on the central support plate 130 and the second plurality of teeth 184 align with and engage a second plurality of openings 188 on the central support plate 130.

Once the main support 152 is positioned in the desired openings 14 on the upright frame member 16, the button 164 is depressed so that the shaft 176 engages one of the openings 14 on the upright frame member 16 to lock the main support 152 relative to the upright frame member 16. The secondary support 154 is then pivoted and slid about studs 166, 178 so that the first hook plate 132 is accepted within the groove 168 on the button 164 to allow the button 164 to pass through the connecting portion 174 on the first hook plate 132 to allow the button 164 to be received within the second slot 162.

Figure 17:
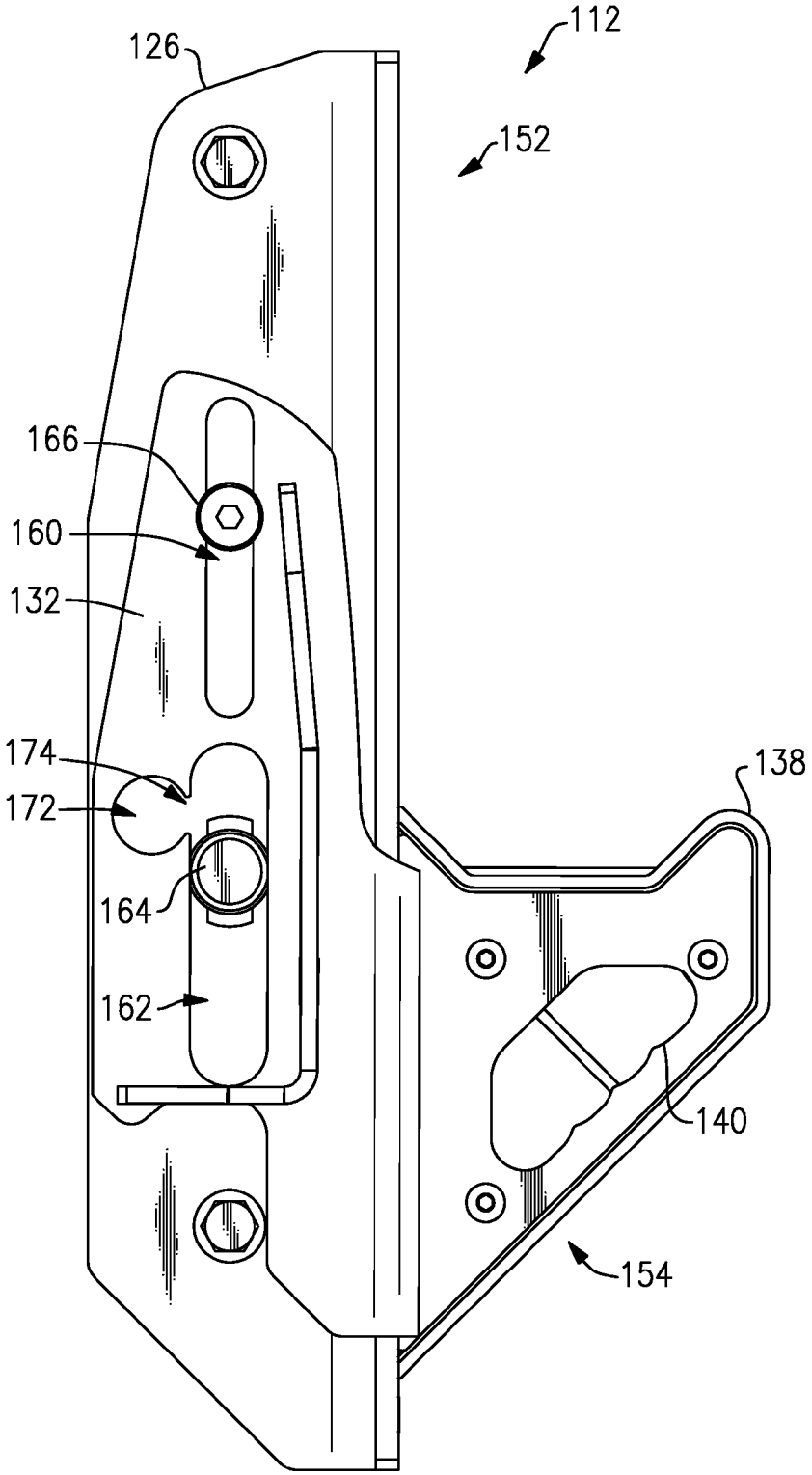
FIG. 17 is a side view of the support assembly of FIG. 4 with the secondary support in a first position relative to the main support.
Figure 18:
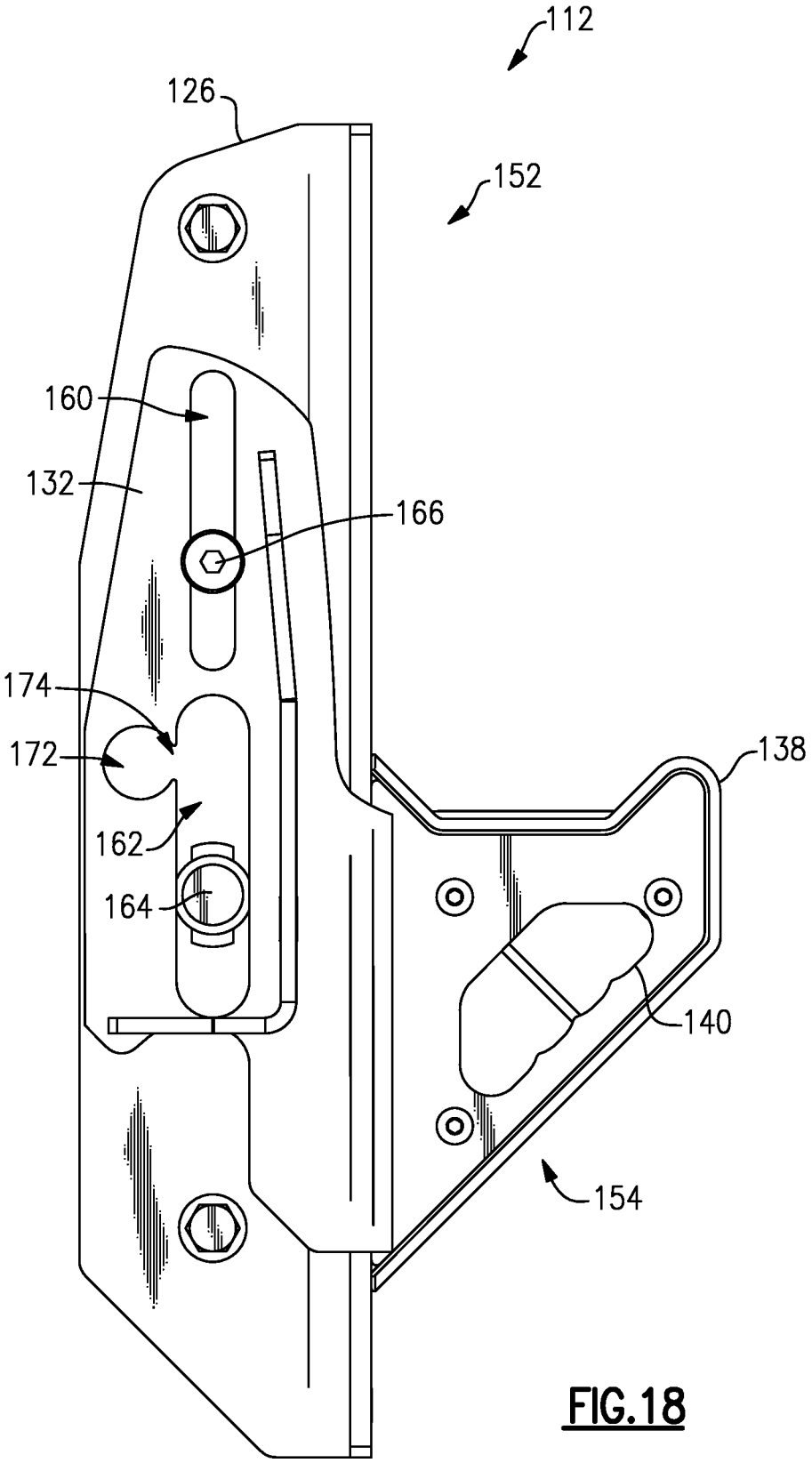
FIG. 18 is a side view of the support assembly of FIG. 4 with the secondary support in a second position relative to the main support.
Figure 19:
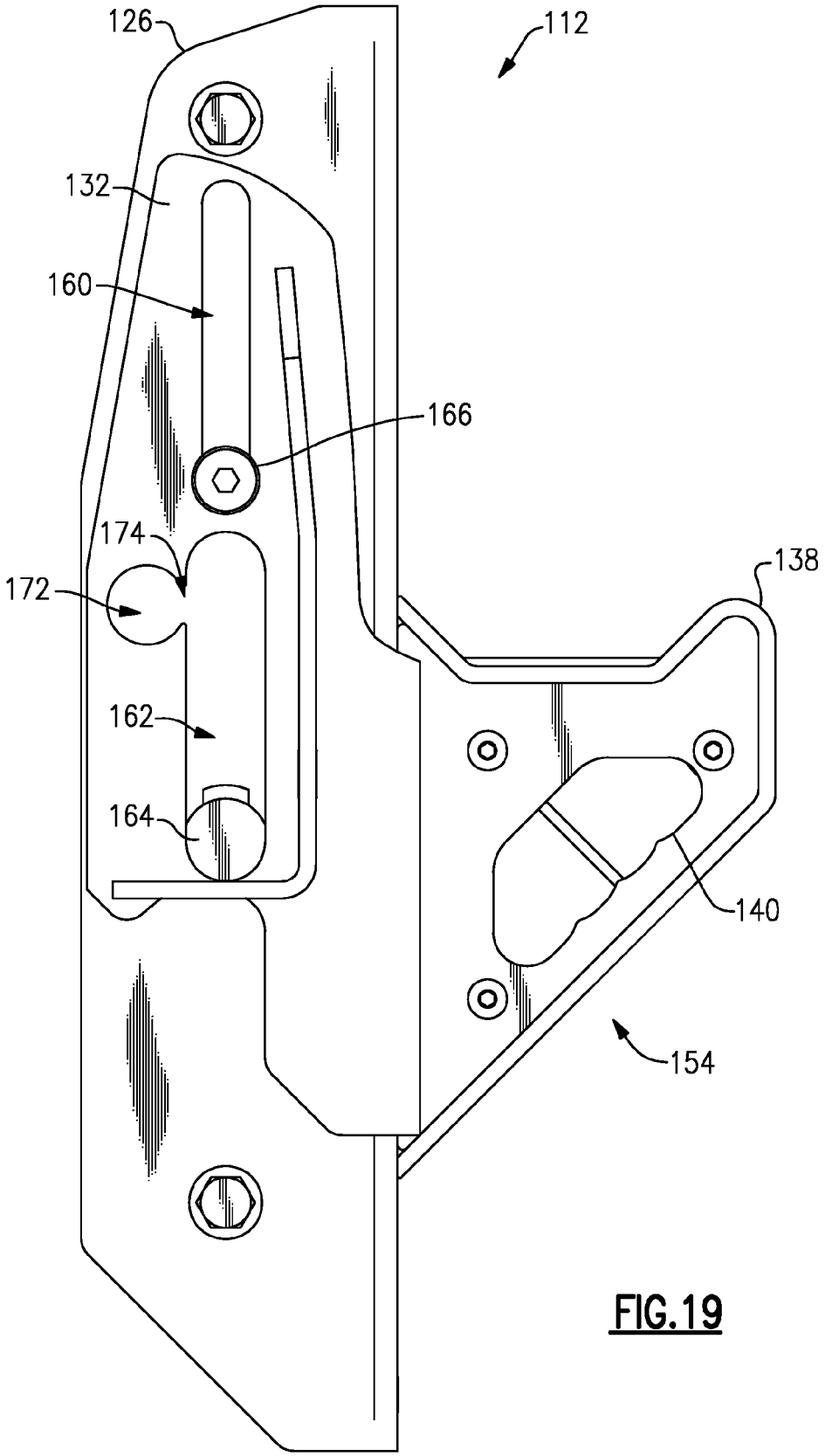
FIG. 19 is a side view of the support assembly of FIG. 4 with the secondary support in a third position relative to the main support.

When the button 164 is positioned within the second slot 162, the secondary support 154 is moveable relative to the main support 152 by having at least a portion of the first hook plate 132 received within the groove 168. By receiving a portion of the first hook plate 132 within the groove 168, sufficient clearance exists between the first and second plurality of teeth 182, 184 and the main support 152 to allow for the first and second plurality of teeth 182, 184 to be aligned with the first and second plurality of openings 186, 188, which allows for the secondary support 154 to be located in a plurality of positions relative to the main support 152 as illustrated in FIGS. 17-19.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A weight support assembly comprising:

a main support mountable to an upright frame member to define at least one coarse position along a first axis; and a secondary support movable relative to the main support to define at least one fine position along a second axis aligned with the first axis, wherein the main support is configured to slideably engage with the upright frame and to slideably disengage from the upright frame.

2. A weight support assembly comprising:

a main support mountable to an upright frame member to define a coarse position; and a secondary support movable relative to the main support to define a fine position, wherein said secondary support is configured to pivot and slide relative to the main support.

3. The weight support assembly of claim 1, wherein the main support includes a first support plate opposed to and generally parallel to a second support plate and the first support plate and the second support plate extend generally perpendicularly from a central support plate.

4. The weight support assembly of claim 1, wherein the secondary support includes a first hook plate and a second hook plate that at least partially surrounding the main support and the first hook plate and the second hook plate form recess configured to accept a weight bar.

5. The weight support assembly of claim 4, further comprising a bumper extending between the first hook plate and the second hook plate.

6. The weight support assembly of claim 5, further comprising a wear pin mounted in the bumper.

7. The weight support assembly of claim 6, wherein the wear pin is a roller bearing.

8. The weight support assembly of claim 1, further comprising a plurality of studs extending from the main support for engaging an upright frame member.

9. The weight support assembly of claim 1, wherein the main support includes at least one opening to accept at least one protrusion on the secondary support for securing the secondary support relative to the main support.

10. The weight support assembly of claim 9, wherein the at least one opening is an elongated slot and the at least one protrusion is an angled surface.

11. The weight support assembly of claim 2, further comprising a locking mechanism on the secondary support for engaging the upright frame member.

12. The weight support assembly of claim 2, further comprising a locking mechanism on the main support for engaging the upright frame member.

13. The weight support assembly of claim 9, wherein the at least one opening includes a first plurality of vertically spaced protrusions and a second plurality of vertically spaced protrusions, and the at least one opening includes a first plurality of vertically spaced openings for mating with the first plurality of vertically spaced protrusions and a second plurality of vertically spaced openings for mating with the second plurality of vertically spaced protrusions.

14. The weight support assembly of claim 1, wherein the at least one fine position includes less than five fine positions and more than one fine position.

15. A method of operating a weight support assembly comprising:

attaching a main support relative to a frame member to define at least one coarse vertical adjustment; and adjusting a secondary support relative to the main support to define at least one fine vertical adjustment, wherein the secondary support is configured to pivot and slide relative to the main support.

16. The method of claim 15, wherein the main support includes a lock member for securing the main support to the frame member.

17. The method of claim 15, wherein the secondary support includes a lock member for securing the main support relative to the frame member.

18. The method of claim 15, further comprising engaging at least one protrusion on the secondary support with at least one opening on the main support.

19. The method of claim 15, wherein the at least one fine adjustment includes less than five fine positions and more than one fine position.

20. The weight support assembly of claim 1, wherein the first axis and the second axis are coaxial.

21. A weight support assembly comprising:

a main support mountable to an upright frame member to define a coarse vertical position; and a secondary support movable relative to the main support to define a fine vertical position, wherein the main support includes a lock member to secure the main support to the frame member.

* * * * *